US010470570B2

(12) United States Patent
Chen et al.

(10) Patent No.: US 10,470,570 B2
(45) Date of Patent: Nov. 12, 2019

(54) COUPLING MECHANISM AND SLIDE RAIL ASSEMBLY FOR FURNITURE PART

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Fang-Cheng Su, Kaohsiung (TW); Ci-Bin Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/797,030

(22) Filed: Oct. 30, 2017

(65) Prior Publication Data

US 2018/0255927 A1 Sep. 13, 2018

(30) Foreign Application Priority Data

Mar. 7, 2017 (TW) ..... 106107480 A

(51) Int. Cl.
*A47B 88/427* (2017.01)
*A47B 88/407* (2017.01)
*A47B 88/49* (2017.01)

(52) U.S. Cl.
CPC ..... *A47B 88/427* (2017.01); *A47B 88/407* (2017.01); *A47B 88/49* (2017.01); *A47B 2088/4272* (2017.01); *A47B 2210/0054* (2013.01); *A47B 2210/0056* (2013.01)

(58) Field of Classification Search
CPC ..... A47B 88/427; A47B 88/49; A47B 88/407; A47B 2210/0054; A47B 2210/0056; A47B 88/423; A47B 88/46; A47B 2088/4675; A47B 88/467; A47B 88/47; A47B 88/0481; A47B 88/483; A47B 88/956; A47B 2088/4272; A47B 2088/4276; A47B 2088/4278
USPC ..... 384/22; 312/333, 319.1, 334.8, 334.4, 312/334.1, 334.5, 330.1, 334.6
See application file for complete search history.

(56) References Cited

U.S. PATENT DOCUMENTS

| | | | | |
|---|---|---|---|---|
| 8,052,234 | B2 | 11/2011 | Liang et al. | |
| 8,854,769 | B1 * | 10/2014 | Liang | A47B 88/427 360/125.51 |
| 8,991,952 | B2 * | 3/2015 | Salice | A47B 88/427 312/334.4 |
| 9,259,087 | B1 * | 2/2016 | Hsiao | A47B 88/956 |
| 9,693,627 | B2 * | 7/2017 | Chen | A47B 88/407 |
| 2004/0227440 | A1 * | 11/2004 | Booker | F16F 9/0218 312/334.1 |

(Continued)

*Primary Examiner* — Hiwot E Tefera
(74) *Attorney, Agent, or Firm* — Rosenberg, Klein & Lee

(57) ABSTRACT

A coupling mechanism adapted for a slide rail includes a coupling base, a supporting member, and an adjustment member. The coupling base is detachably fixed to the slide rail. The supporting member includes a supporting portion. The adjustment member is configured for displacing and thereby adjusting the supporting member with respect to the coupling base in order to change the height of the supporting portion of the supporting member with respect to the slide rail through a guiding feature.

8 Claims, 12 Drawing Sheets

(56) References Cited

U.S. PATENT DOCUMENTS

| | | | | |
|---|---|---|---|---|
| 2009/0236959 | A1* | 9/2009 | Liang | A47B 88/427 312/334.4 |
| 2009/0251037 | A1* | 10/2009 | Berger | A47B 88/427 312/334.1 |
| 2012/0080988 | A1* | 4/2012 | Greussing | A47B 88/427 312/334.6 |
| 2012/0292465 | A1* | 11/2012 | Holzer | A47B 88/427 248/201 |
| 2012/0311818 | A1* | 12/2012 | Grabher | E05F 5/02 16/82 |
| 2013/0293077 | A1* | 11/2013 | Haemmerle | A47B 88/931 312/319.1 |
| 2013/0293078 | A1* | 11/2013 | Haemmerle | A47B 88/956 312/333 |
| 2014/0055020 | A1* | 2/2014 | Gasser | A47B 88/57 312/333 |
| 2014/0175965 | A1* | 6/2014 | Salice | A47B 88/427 312/334.1 |
| 2014/0314347 | A1* | 10/2014 | Huang | A47B 88/427 384/22 |
| 2015/0147008 | A1* | 5/2015 | McGregor | A47B 88/407 384/22 |
| 2016/0025124 | A1* | 1/2016 | Roedder | F16B 12/04 403/14 |
| 2016/0128476 | A1* | 5/2016 | Ng | E05B 65/46 312/333 |
| 2016/0198855 | A1* | 7/2016 | Liang | A47B 88/427 248/241 |
| 2017/0172299 | A1* | 6/2017 | Schneider | F16C 29/001 |

* cited by examiner

COUPLING MECHANISM AND SLIDE RAIL ASSEMBLY FOR FURNITURE PART

FIELD OF THE INVENTION

The present invention relates to a mechanism and a slide rail. More particularly, the present invention relates to a coupling mechanism and a slide rail assembly for use with a furniture part.

BACKGROUND OF THE INVENTION

Generally, an undermount drawer slide rail assembly is mounted on the bottom of a drawer and is therefore hidden from view. An undermount drawer slide rail assembly typically includes a first rail and a second rail displaceable with respect to the first rail. More specifically, the first rail is mounted on the body of a cabinet, and the second rail is configured to carry or support a drawer so that the drawer can be easily pulled out of and pushed back into the cabinet body through the second rail with respect to the first rail. The undermount drawer slide rail assembly stays hidden at the bottom of the drawer even when the drawer is pulled out of the cabinet body.

It is well known in the art of furniture slide rails that a drawer can be laterally adjusted, i.e., laterally displaced, with respect to a cabinet body (or slide rail). U.S. Pat. No. 8,854,769 B1, for example, discloses a slide rail system and a connecting device used for a slide rail assembly. The disclosure of this US patent is incorporated herein by reference.

SUMMARY OF THE INVENTION

The present invention relates to a coupling mechanism and a slide rail assembly for use with a furniture part.

According to one aspect of the present invention, a coupling mechanism adapted for a slide rail includes a coupling base, a supporting member, and a height adjustment member. The coupling base is detachably fixed to the slide rail. The supporting member includes a supporting portion. The height adjustment member is configured for displacing and thereby adjusting the supporting member with respect to the coupling base in order to change the height of the supporting portion of the supporting member with respect to the slide rail through a guiding feature.

Preferably, the coupling mechanism is configured for releasably coupling a furniture part to the slide rail, wherein the coupling base is detachably fixed to the slide rail, and the supporting portion of the supporting member is configured to face the furniture and can change the height of the furniture part with respect to the slide rail through the guiding feature.

Preferably, the slide rail has a front portion and a rear portion, the coupling base is mounted on the slide rail at a position adjacent to the front portion of the slide rail, and the guiding feature includes one of an inclined surface and a curved surface.

Preferably, the height adjustment member is rotatably mounted on the coupling base, and the height adjustment member and the supporting member have corresponding threaded structures.

Preferably, the coupling mechanism further includes a first base, a second base, and a lateral adjustment member, wherein the second base can be displaced with respect to the first base, and the lateral adjustment member is configured for laterally displacing and thereby adjusting the second base with respect to the slide rail. In some embodiments, the coupling base is detachably engaged with the first base, the second base is fixedly connected to the furniture part, and the lateral adjustment member is rotatably mounted on one of the first base and the second base and is configured for displacing and thereby adjusting the second base with respect to the first base.

Preferably, the coupling mechanism further includes a transmission structure configured for converting a rotary movement of the lateral adjustment member into a linear displacement of the second base with respect to the first base.

Preferably, the coupling base includes an elastic portion, and the first base includes an engaging structure. The elastic portion of the coupling base is detachably engaged with the engaging structure of the first base and has at least one first engaging section. The engaging structure has at least one second engaging section corresponding to the first engaging section.

Preferably, the first base includes a first feature, and the second base includes a second feature. One of the first feature and the second feature includes at least one projection. The other of the first feature and the second feature includes at least one receiving space for receiving the at least one projection. The at least one receiving space is larger than the at least one projection so that, with the first feature and the second feature working with each other, the second base can be displaced within a limited range with respect to the first base.

Preferably, one of the first base and the second base includes a guiding structure to make it easier to displace the second base with respect to the first base.

Preferably, the transmission structure is located at one of the first base and the second base.

Preferably, the lateral adjustment member is rotatably mounted on the second base and includes an adjusting portion, the transmission structure is located at the first base, and the transmission structure and the adjusting portion are configured to work with each other.

Preferably, the adjusting portion is a substantially spiral guide groove, and the transmission structure is a projection located in the guide groove.

Preferably, the supporting member includes a first threaded structure, the height adjustment member includes a second threaded structure corresponding to the first threaded structure, and the first threaded structure and the second threaded structure are substantially longitudinally arranged.

According to another aspect of the present invention, a slide rail assembly includes a first rail and a second rail adjacent to which the aforesaid coupling mechanism is located, wherein the coupling base of the coupling mechanism is detachably fixed to the second rail. The second rail can be longitudinally displaced with respect to the first rail. The height of the supporting portion of the supporting member with respect to the second rail can be changed through the guiding feature.

Preferably, the coupling base includes a cushioning portion, the first base includes a mounting portion pressed against a first sidewall of the second rail, and the cushioning portion is configured to be pressed against the second base in order for a cushioning movement of the cushioning portion to compensate for a possible longitudinal gap between the first base and the second rail.

DETAILED DESCRIPTION OF THE INVENTION

Figure 1:
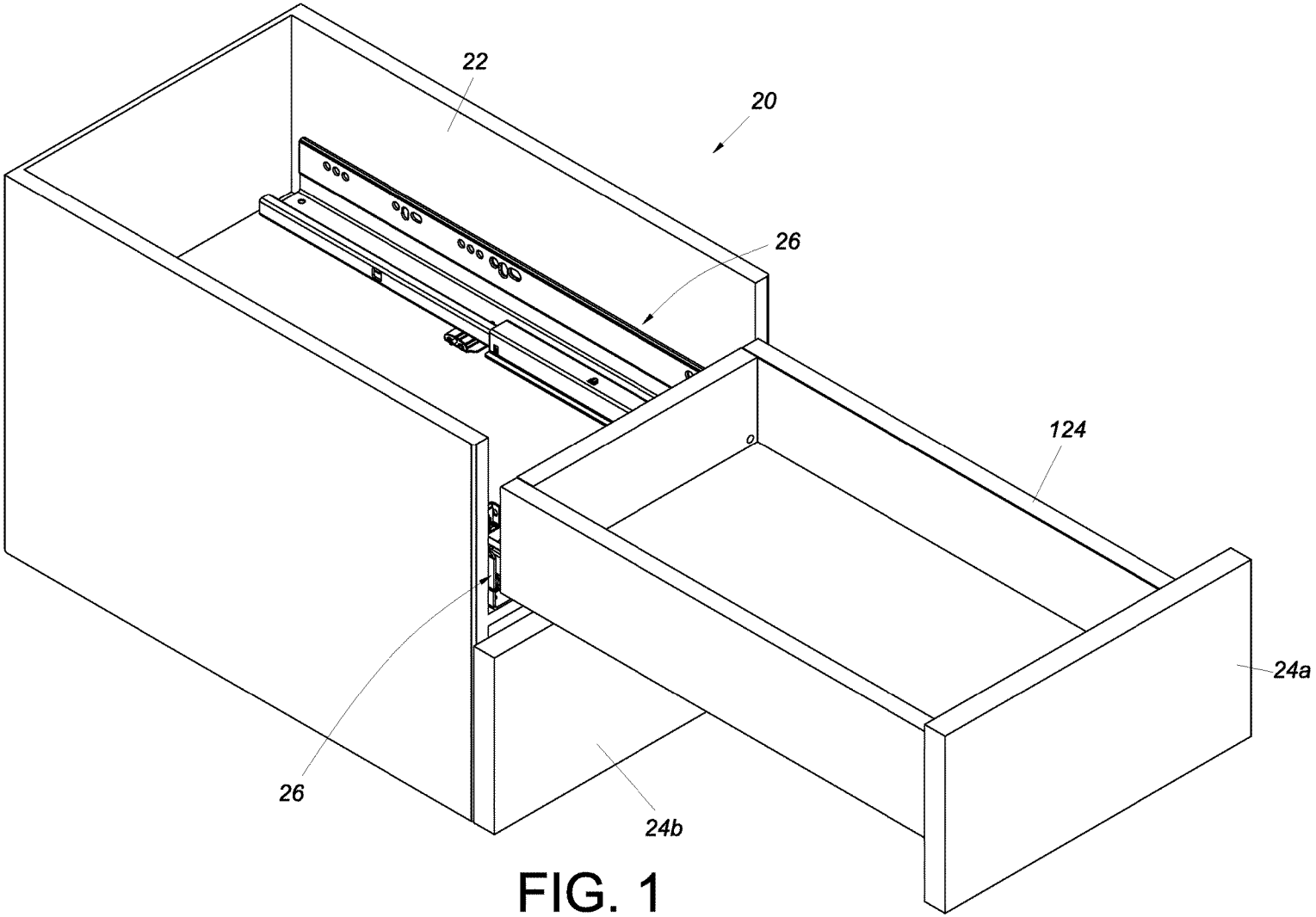
FIG. 1 is a perspective view of a piece of furniture to which an embodiment of the present invention is applied, wherein the furniture includes a first furniture part and two second furniture parts, and wherein one of the second furniture parts is pulled out of the first furniture part via a pair of slide rail assemblies.
Figure 2:
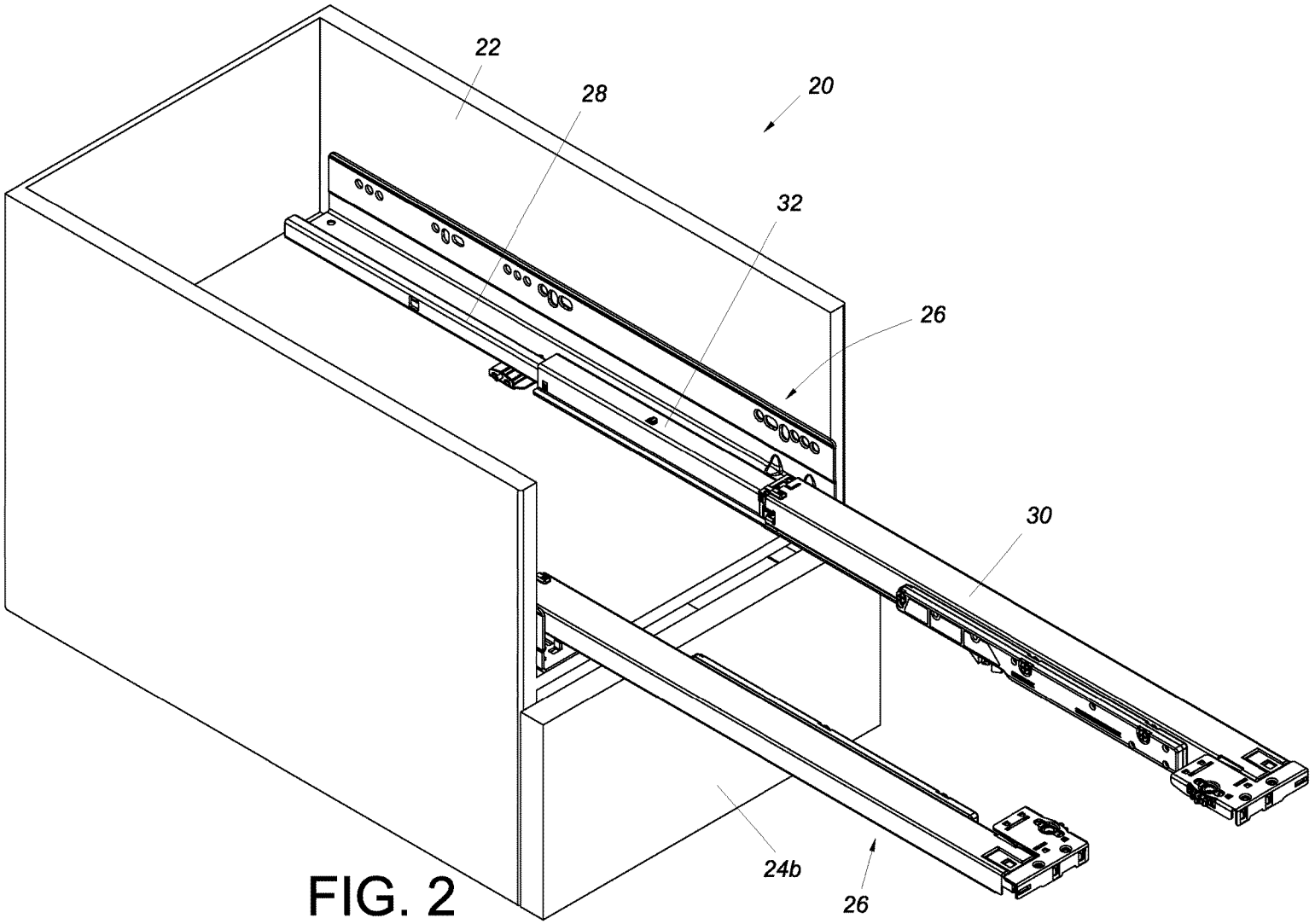
FIG. 2 is similar to FIG. 1 except that one of the second furniture parts is removed.

Referring to FIG. 1 and FIG. 2, a piece of furniture 20 includes a first furniture part 22 and at least one second furniture part (also referred to herein as the furniture part). Here, two second furniture parts 24*a* and 24*b* are provided by way of example. Each second furniture part, such as the second furniture part 24*a*, can be displaced with respect to the first furniture part 22. Preferably, a pair of slide rail assemblies 26 are provided to facilitate displacement of the second furniture part 24*a* with respect to the first furniture part 22. The first furniture part 22 may be the body of a furniture cabinet, and the two second furniture parts 24*a* and 24*b* may be drawers; the present invention has no limitation in this regard. The pair of slide rail assemblies 26 allow the second furniture part 24*a* to be movably mounted on the first furniture part 22. Each slide rail assembly 26 is an under-mount slide rail assembly mounted on the bottom of the second furniture part 24*a* and includes a first rail 28, a second rail 30 (also referred to herein as the slide rail) longitudinally displaceable with respect to the first rail 28, and preferably also a third rail 32 movably mounted between the first rail 28 and the second rail 30 to increase the distance by which the second rail 30 can be displaced with respect to the first rail 28. The first rails 28 are fixedly mounted on the first furniture part 22. The second rails 30 are configured for carrying the second furniture part 24*a* so that the second furniture part 24*a* can be easily displaced from inside the first furniture part 22 to the outside and pushed back into the first furniture part 22 through the second rails 30.

Figure 3:
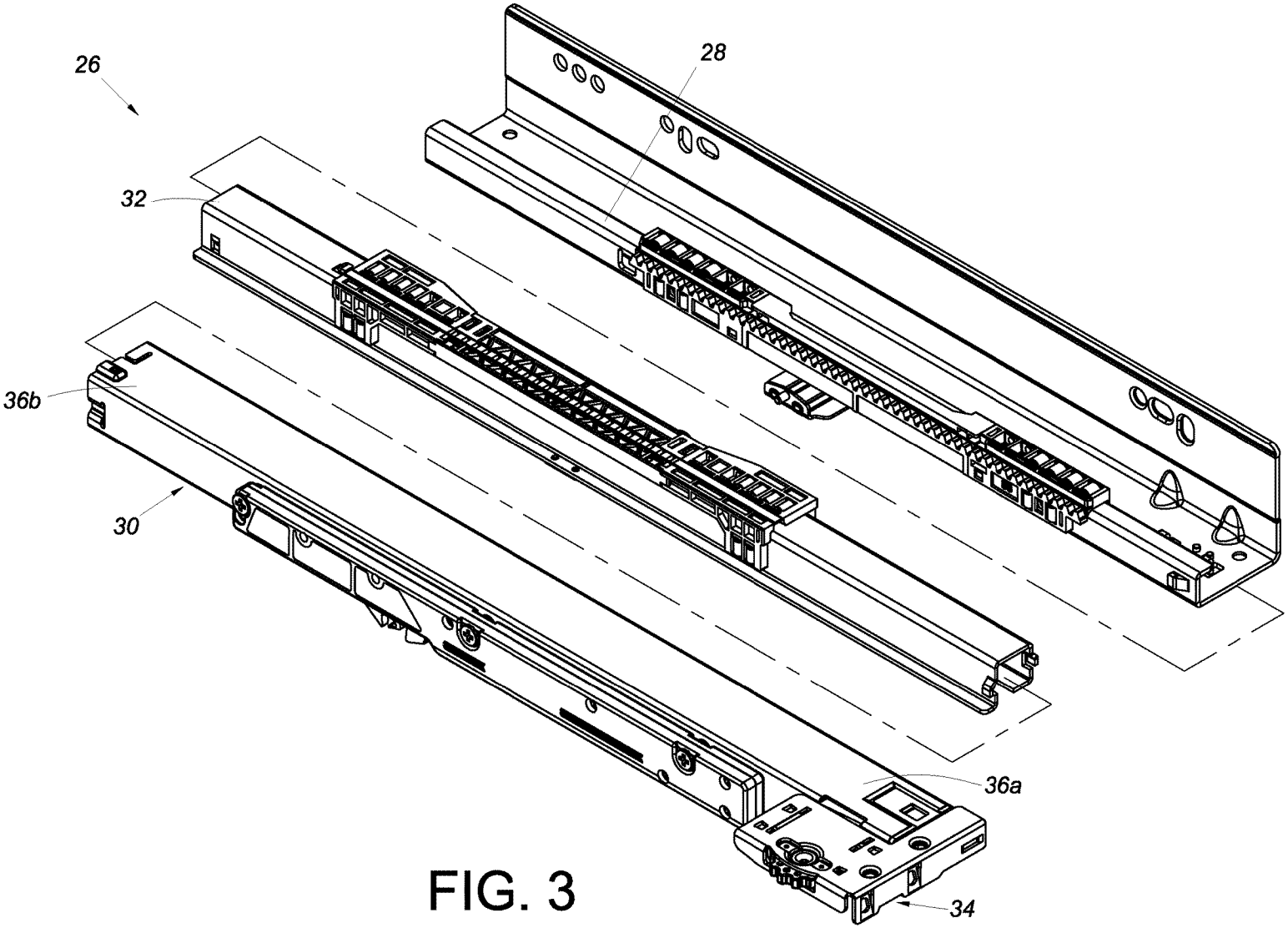
FIG. 3 is an exploded perspective view of the slide rail assembly in an embodiment of the present invention.
Figure 4:
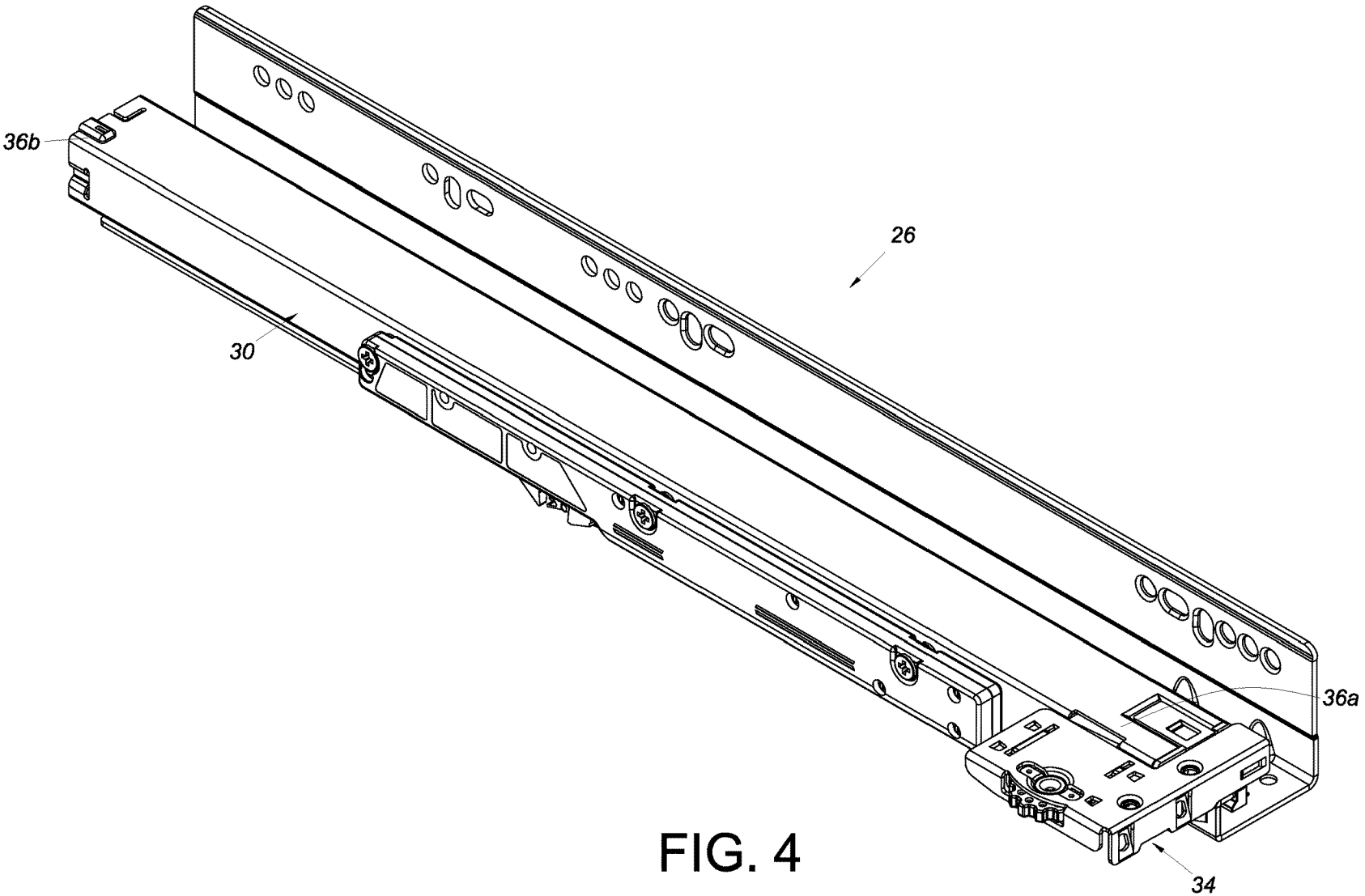
FIG. 4 is an assembled perspective view of the slide rail assembly in an embodiment of the present invention.

Referring to FIG. 3 and FIG. 4, the slide rail assembly 26 includes a coupling mechanism 34 adjacent to the second rail 30. Here, the second rail 30 has a front portion 36*a* and a rear portion 36*b*, and the coupling mechanism 34 is mounted on the second rail 30 at a position adjacent to the front portion 36*a* by way of example.

Figure 5:
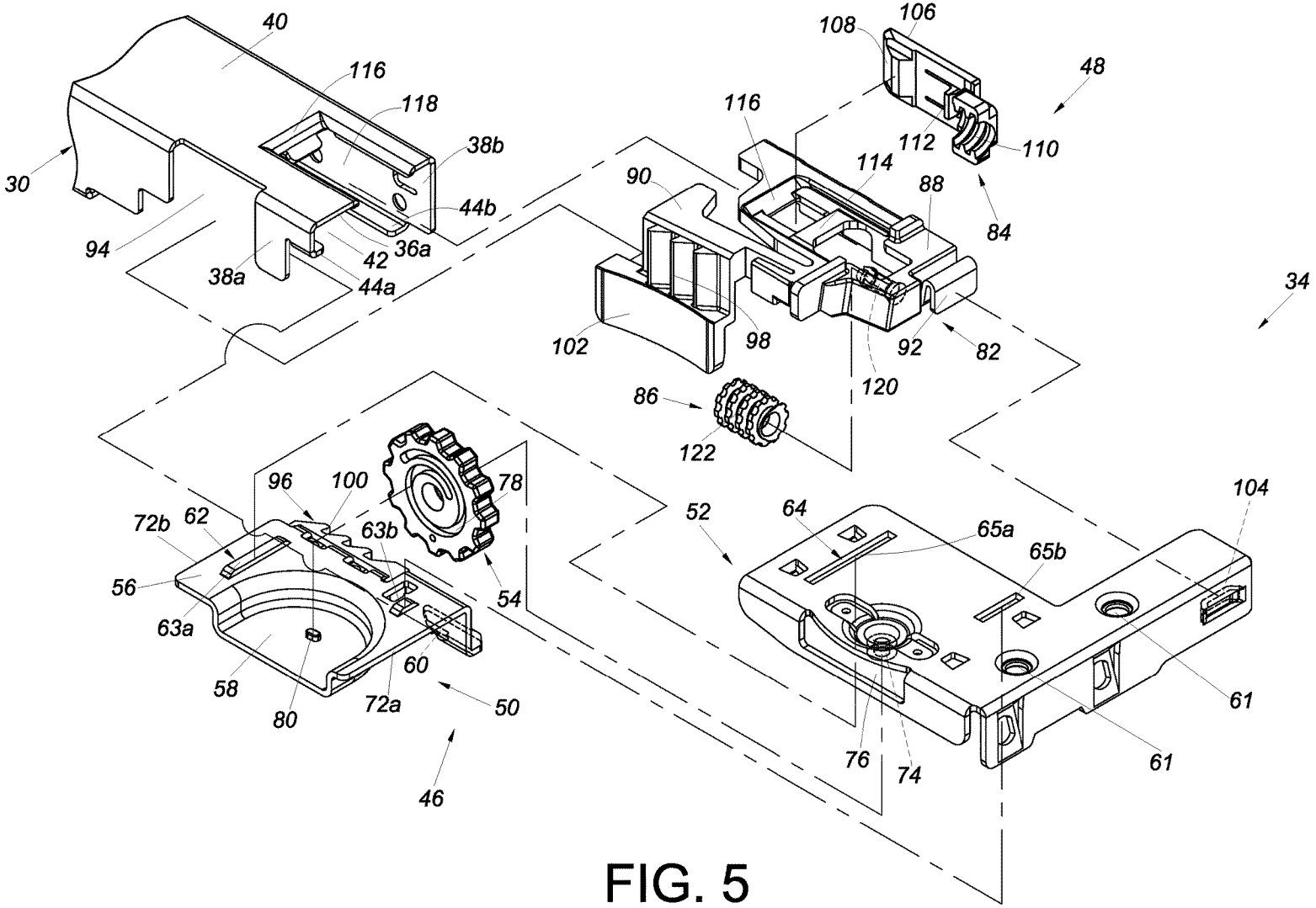
FIG. 5 is an exploded perspective view of the coupling mechanism and a slide rail in accordance with an embodiment of the present invention.
Figure 6:
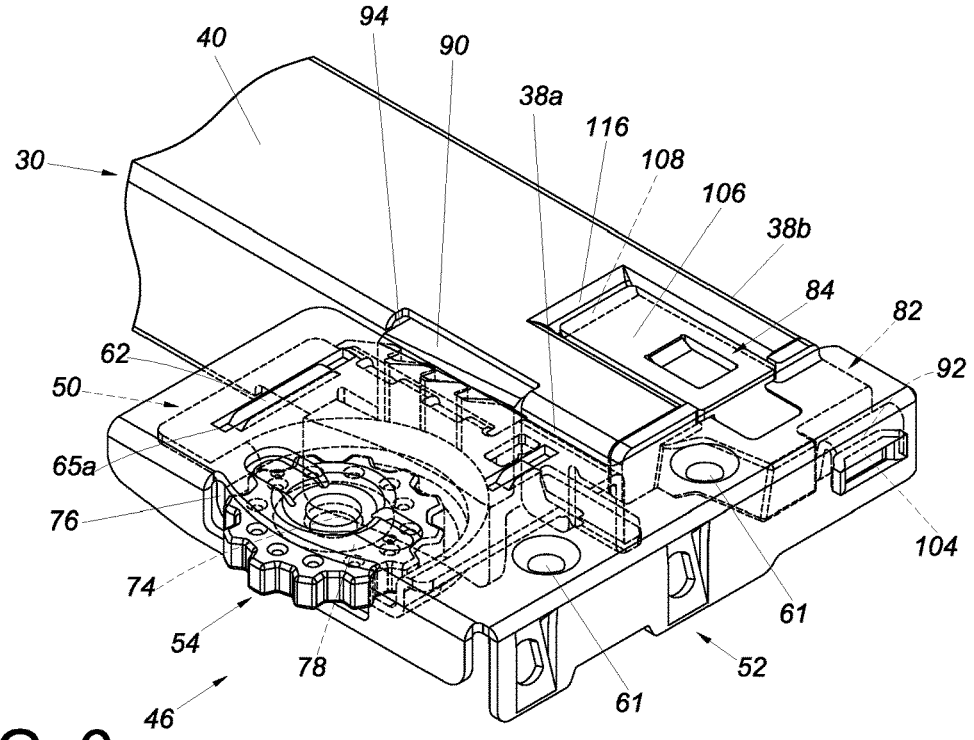
FIG. 6 is an assembled perspective view of the coupling mechanism and the slide rail in accordance with an embodiment of the present invention.
Figure 7:
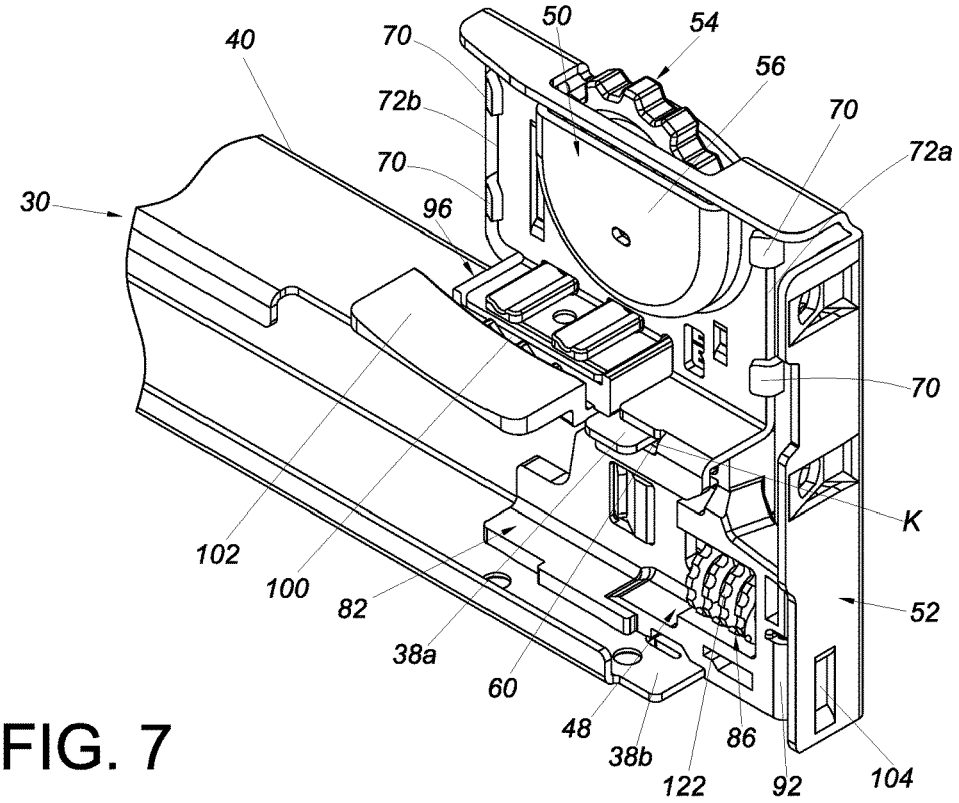
FIG. 7 shows the coupling mechanism and the slide rail in an embodiment of the present invention from another viewing angle.

Referring to FIG. 5, FIG. 6, and FIG. 7, the second rail 30 includes a first sidewall 38*a*, a second sidewall 38*b*, and a carrying portion 40 located between the first sidewall 38*a* and the second sidewall 38*b*. The first sidewall 38*a*, the second sidewall 38*b*, and the carrying portion 40 jointly define a supporting space 42. The second rail 30 preferably further includes a first extension section 44*a* and a second extension section 44*b* which are substantially perpendicularly connected to the first sidewall 38*a* and the second sidewall 38*b* respectively. The first extension section 44*a* and the second extension section 44*b* are adjacent to the supporting space 42.

The coupling mechanism 34 includes a height adjustment device 48 and preferably also a lateral adjustment device 46.

The height adjustment device 48 includes a coupling base 82, a supporting member 84, and a height adjustment member 86.

The coupling base 82 is detachably fixed to the second rail 30. Preferably, the coupling base 82 is made of a flexible material (e.g., plastic). The coupling base 82 is fixedly mounted on the second rail 30 at a position adjacent to the front portion 36*a* and preferably includes a main portion 88, an elastic portion 90, and a cushioning portion 92. The main portion 88 is mounted in the supporting space 42 of the second rail 30, preferably with the first extension section 44*a* and the second extension section 44*b* of the second rail 30 providing support for the main portion 88. The elastic portion 90 is connected to and located at a lateral side of the main portion 88 and juts out of the supporting space 42 through a notch 94 of the second rail 30. The cushioning portion 92 is connected to and located at the front side of the main portion 88.

The supporting member 84 is movably mounted on the coupling base 82 and includes a supporting portion 106. The supporting member 84 preferably also includes a first guiding feature 108 (also referred to herein as the guiding feature), a first threaded structure 110, and a stop portion 112. Preferably, the supporting portion 106, the first guiding feature 108, the first threaded structure 110, and the stop portion 112 are integrally formed, and the first guiding feature 108 and the stop portion 112 are located at a bottom portion of the supporting portion 106. The stop portion 112 lies between the first guiding feature 108 and the first threaded structure 110 and corresponds in position to a position-limiting section 114 of the coupling base 82. Preferably, the second rail 30 and/or the coupling base 82 has a second guiding feature 116 (also referred to herein as the guiding feature) corresponding to the first guiding feature 108 of the supporting member 84, and the guiding features 108 and 116 are inclined or curved surfaces. Preferably, the carrying portion 40 of the second rail 30 has an upper notch 118 in communication with the supporting space 42. When the main portion 88 of the coupling base 82 is mounted in the supporting space 42 of the second rail 30, the supporting portion 106 of the supporting member 84 is located in the upper notch 118.

The height adjustment member 86 is configured to adjust, or more particularly displace, the supporting member 84 with respect to the coupling base 82. The height adjustment member 86 is rotatably mounted on one of the coupling base 82 and the supporting member 84. Here, the height adjustment member 86 is rotatably mounted on the coupling base 82. For example, the coupling base 82 has a shaft portion 120 that is substantially longitudinally arranged for mounting the height adjustment member 86. The height adjustment member 86 includes a second threaded structure 122 corresponding to the first threaded structure 110 of the supporting member 84. Here, the first threaded structure 110 and the second threaded structure 122 are substantially longitudinally arranged.

The lateral adjustment device 46 includes a first base 50, a second base 52, and a lateral adjustment member 54.

The first base 50 is coupled to the second rail 30 (e.g., to a portion of the second rail 30 that is adjacent to the front portion 36*a*) via the coupling base 82. Preferably, the first base 50 includes a main body 56, a mounting space 58, and a mounting portion 60. The mounting space 58 is located at the main body 56. The mounting portion 60 (e.g., a hook configured to hook to the first sidewall 38*a* of the second rail 30 in a detachable manner) is located on one side of the main body 56. Preferably, the first base 50 includes an engaging structure 96, and the elastic portion 90 of the coupling base 82 is detachably engaged with the engaging structure 96 of the first base 50. More specifically, the elastic portion 90 includes at least one first engaging section 98, and the engaging structure 96 includes at least one second engaging section 100 corresponding to the first engaging section 98. Preferably, the at least one first engaging section 98 and the at least one second engaging section 100 have serrated contours. Preferably, the coupling base 82 further includes an operating portion 102 extending from the elastic portion 90. The operating portion 102 makes it easier for an operator to press the elastic portion 90 and thereby disengage the first engaging section 98 of the elastic portion 90 from the second engaging section 100 of the first base 50. Or, the operating portion 102 can be operated to bring the first engaging section 98 back into the supporting space 42 so that the coupling base 82 can be removed from the second rail 30.

The second base 52 can be displaced with respect to the first base 50. Preferably, the first base 50 includes at least one first feature 62, and the second base 52 includes at least one second feature 64. The first feature 62 and the second feature 64 are configured to work with each other in order for the second base 52 to be linearly displaceable within a limited range with respect to the first base 50. For example, the first feature 62 includes two differently shaped projections 63*a* and 63*b*, and the second feature 64 includes two sub-features that correspond to the two projections 63*a* and 63*b* of the first feature 62 respectively. For example, the second feature 64 includes two receiving spaces 65*a* and 65*b* for receiving the two projections 63*a* and 63*b* respectively. The two receiving spaces 65*a* and 65*b* may be slots or long, narrow grooves for example, wherein the slots or long, narrow grooves are substantially transversely arranged and are slightly longer or larger than the two projections 63*a* and 63*b* of the first feature 62 respectively so that the second base 52 can be linearly displaced with respect to the first base 50 within a limited range by means of the two projections 63*a* and 63*b* and the two receiving spaces 65*a* and 65*b*. It is worth mentioning that the structural features of the first feature 62 and the second feature 64 are interchangeable; the present invention has no limitation in this regard, provided that the first base 50 and the second base 52 are movable with respect to each other while connected. Besides, one of the first base 50 and the second base 52 includes at least one guiding structure 70 (see FIG. 7) for guiding the second base 52 in predetermined directions with respect to the first base 50. Here, the second base 52 includes two pairs of guiding structures 70 by way of example. The guiding structures 70 (e.g., protruding blocks) serve to keep two corresponding edges 72*a* and 72*b* (e.g., a front edge and a rear edge) of the first base 50 in position. Preferably, the second base 52 includes a contact portion 104 corresponding to the cushioning portion 92 of the coupling base 82. When the second base 52 is pressed against the cushioning portion 92, the cushioning portion 92 can make a cushioning movement to compensate for a longitudinal gap K that may exist between the first base 50 and the second rail 30.

The lateral adjustment member 54 is configured to adjust the second base 52, or more particularly to displace the second base 52 laterally (or transversely), with respect to the longitudinal length of the second rail 30. The lateral adjustment member 54 is rotatably mounted on one of the first base 50 and the second base 52. Here, the lateral adjustment member 54 is rotatably mounted on the second base 52. For example, the second base 52 includes a shaft 74, and the lateral adjustment member 54 is rotatably mounted to the second base 52 via the shaft 74. Preferably, the lateral adjustment member 54 is received in the mounting space 58 of the first base 50 and is partially exposed through an aperture 76 of the second base 52 so that an operator can rotate the lateral adjustment member 54 with ease. Preferably, the lateral adjustment member 54 includes an adjusting portion 78, and one of the first base 50 and the second base 52 is equipped with a transmission structure 80 (see FIG. 5). Here, by way of example, it is the first base 50 that is equipped with the transmission structure 80. The transmission structure 80 is configured to work with the adjusting portion 78. The adjusting portion 78 is preferably arranged in a substantially spiral manner.

Figure 8:
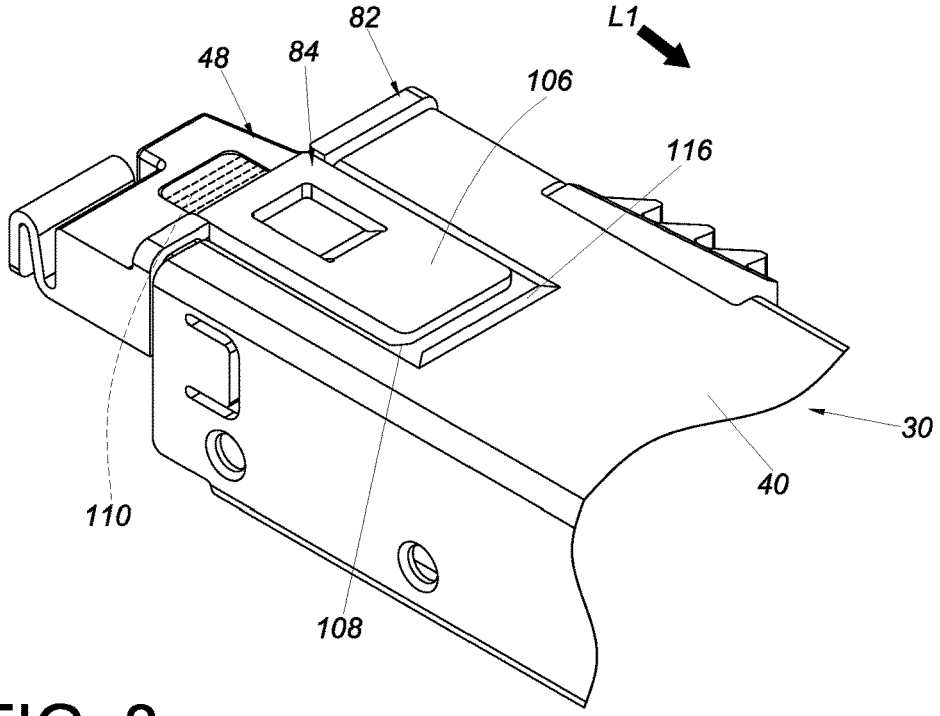
FIG. 8 is an assembled perspective view of the height adjustment device of the coupling mechanism and a slide rail in accordance with an embodiment of the present invention, wherein the supporting member of the height adjustment device is not yet adjusted and is at a certain position with respect to the slide rail.
Figure 9:
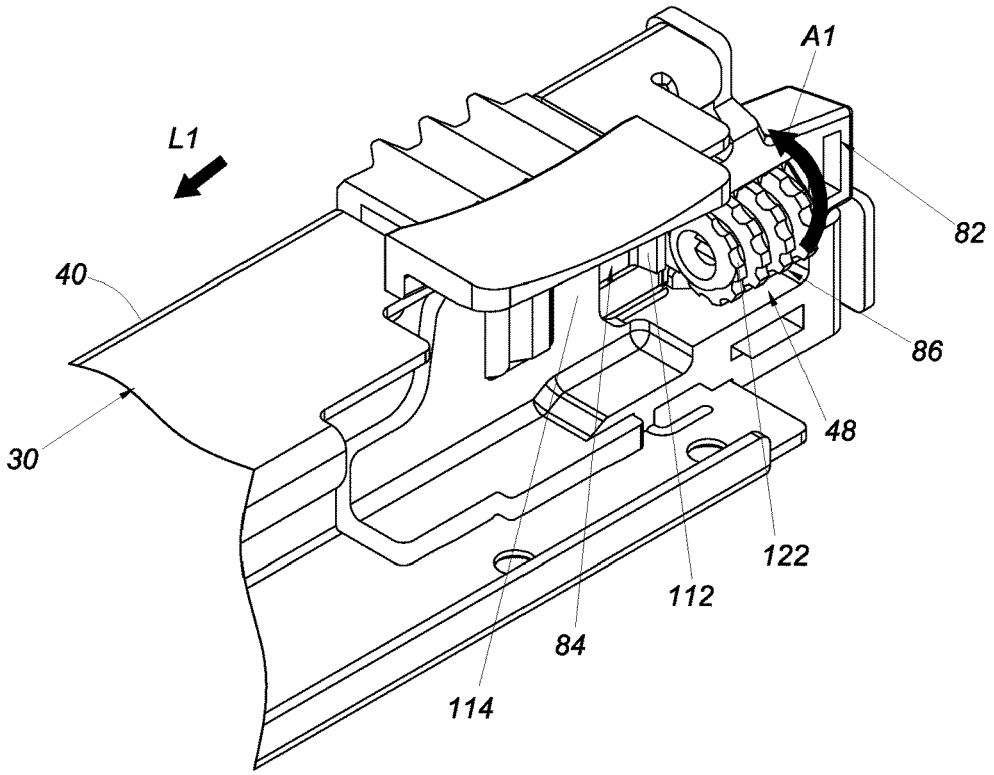
FIG. 9 shows the height adjustment device and the slide rail in accordance with an embodiment of the present invention from another viewing angle.
Figure 10:
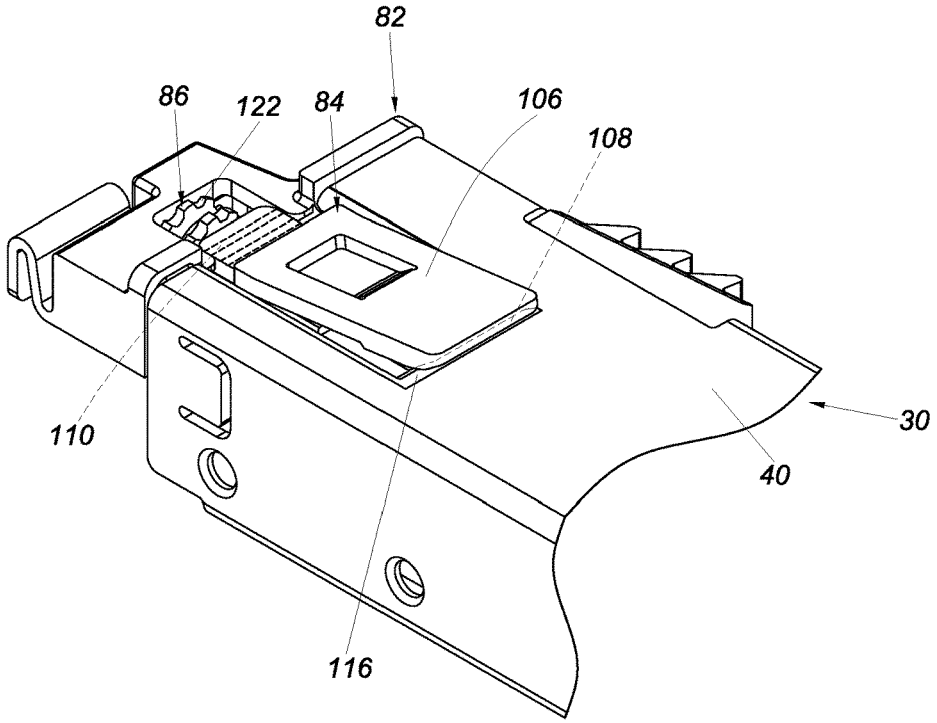
FIG. 10 shows that the supporting member of the height adjustment device is adjusted and therefore at another position with respect to the slide rail in accordance with an embodiment of the present invention.

Referring to FIG. 8, FIG. 9, and FIG. 10, the supporting portion 106 of the supporting member 84 is substantially lower than or as high as the carrying portion 40 of the second rail 30. An operator may rotate the height adjustment member 86 in a first operation direction A1 with respect to the coupling base 82 so that the second threaded structure 122 of the height adjustment member 86 works with the first threaded structure 110 of the supporting member 84 to displace the supporting member 84 with respect to the coupling base 82. Furthermore, the supporting portion 106 of the supporting member 84 will rise from its original position to another position, i.e., be adjusted in height with respect to the carrying portion 40 of the second rail 30, thanks to the first guiding feature 108 and/or the second guiding feature 116.

Figure 11:
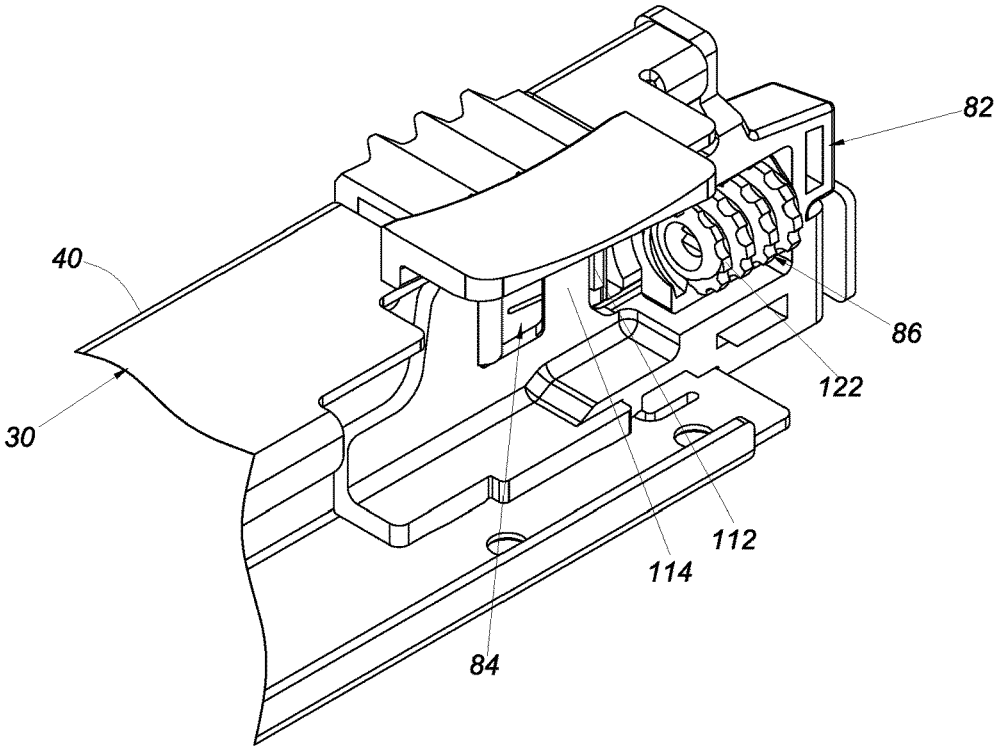
FIG. 11 shows the height adjustment device and the slide rail in FIG. 10 from another viewing angle.

When the operator rotates the height adjustment member 86 in the first operation direction A1, referring to FIG. 9 and FIG. 11, the supporting member 84 is displaced in a first longitudinal direction L1 with respect to the coupling base 82 and/or the second rail 30. Once displaced a predetermined distance in the first longitudinal direction L1, the stop portion 112 of the supporting member 84 is blocked by the position-limiting section 114 of the coupling base 82 to prevent the supporting member 84 from excessive displacement in the first longitudinal direction L1.

It is worth mentioning that the operator may also rotate the height adjustment member 86 in a second operation direction (e.g., the opposite direction of the first operation direction A1), thereby displacing the supporting member 84 in a second longitudinal direction (e.g., the opposite direction of the first longitudinal direction L1) to lower the supporting portion 106 of the supporting member 84 with respect to the carrying portion 40 of the second rail 30.

Figure 12:
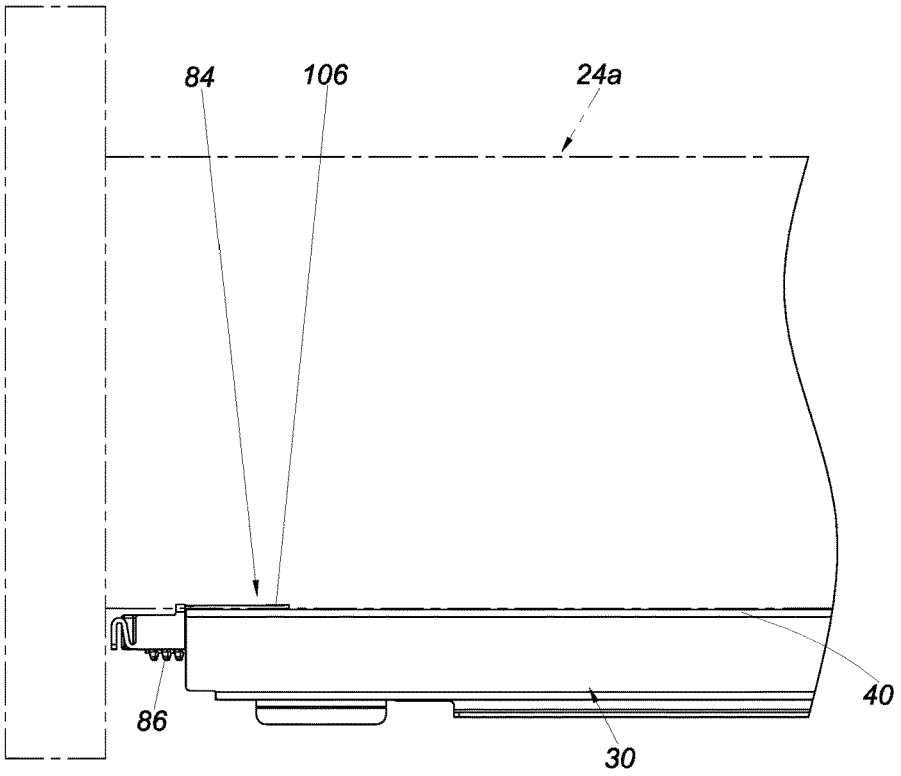
FIG. 12 shows how a slide rail carries a second furniture part in accordance with an embodiment of the present invention.
Figure 13:
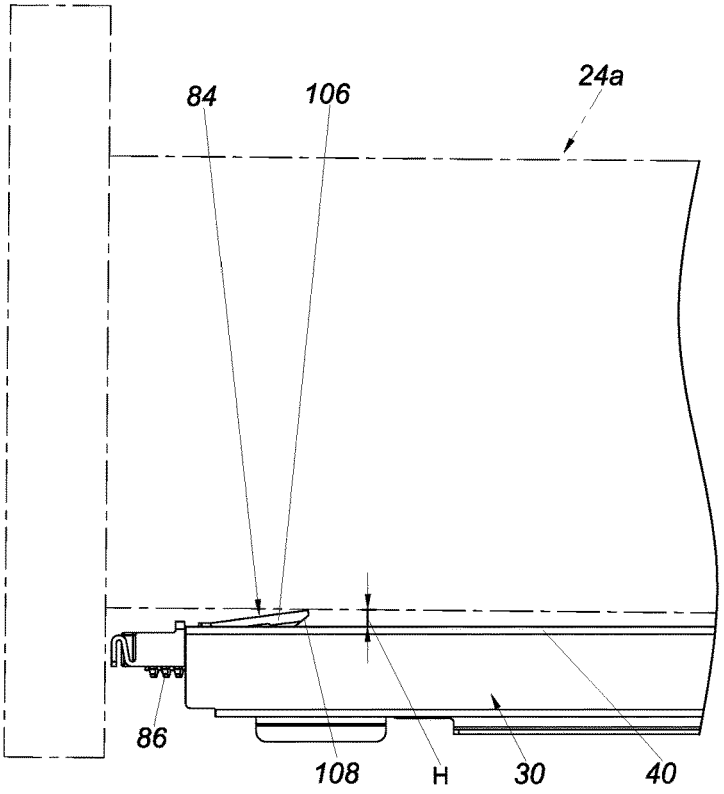
FIG. 13 shows that, after adjusting the height adjustment device, the second furniture part is vertically spaced apart from the slide rail in accordance with an embodiment of the present invention.

Referring to FIG. 12 and FIG. 13, when the second furniture part 24*a* is mounted on the second rail 30, the carrying portion 40 of the second rail 30 carries or supports the second furniture part 24*a*, and the supporting portion 106 of the supporting member 84 faces the second furniture part 24*a*. By adjusting the height adjustment member 86 (e.g., by rotating it in the first operation direction A1), the supporting portion 106 of the supporting member 84 can be raised with respect to the carrying portion 40 of the second rail 30 by a height H by means of the first guiding feature 108 and/or the second guiding feature 116. That is to say, the supporting member 84 can change the vertical distance H between a portion of the second furniture part 24*a* and the carrying portion 40 of the second rail 30 via the guiding feature 108 or 116, thereby adjusting the front-end height of the second furniture part 24*a* with respect to the first furniture part 22 in order to correct a front-end mounting error of the second furniture part 24*a* with respect to the first furniture part 22.

Figure 14:
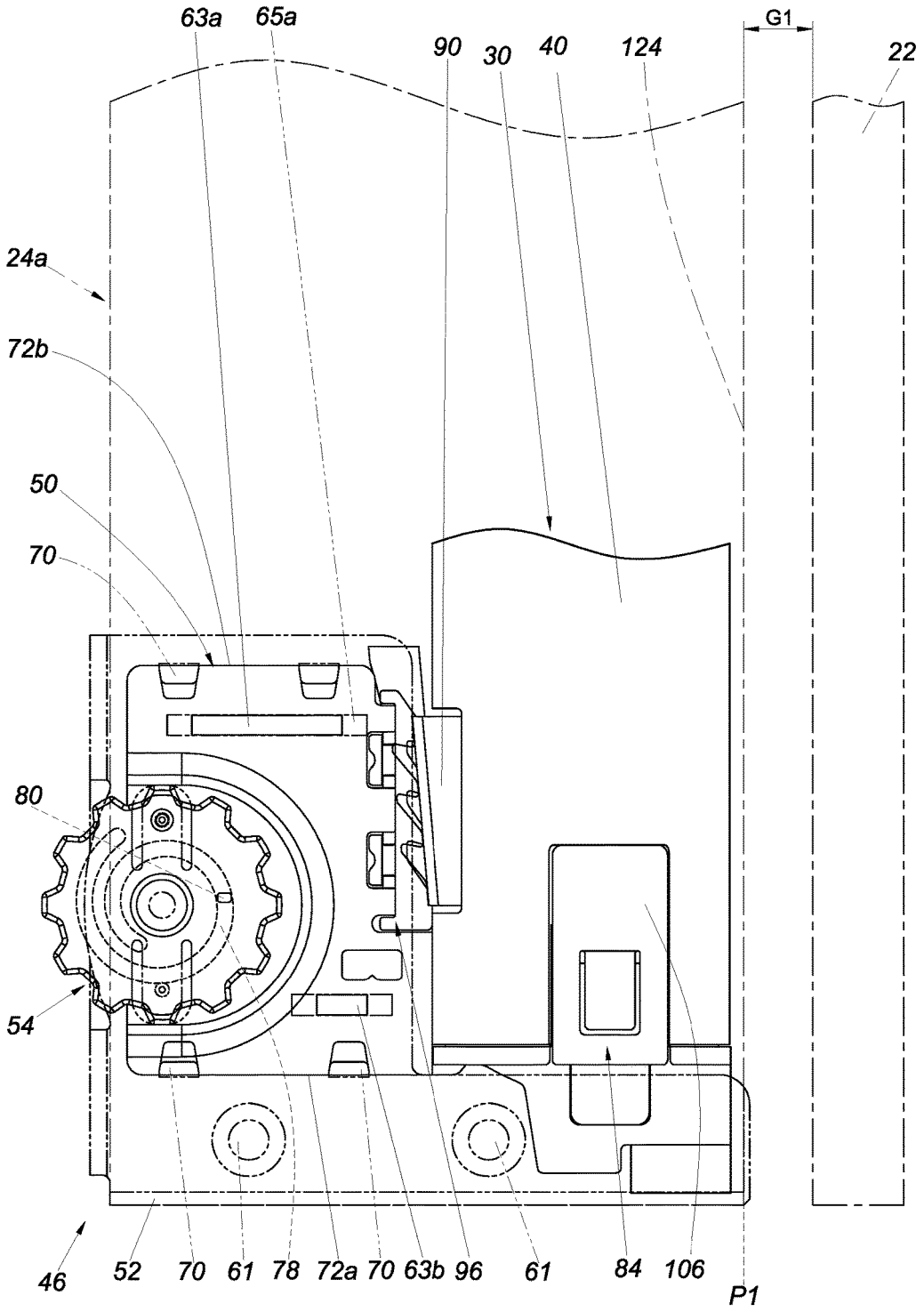
FIG. 14 shows how a second furniture part is mounted to a slide rail through the coupling mechanism in accordance with an embodiment of the present invention, wherein the second furniture part is spaced apart from the first furniture part by a first distance.

Referring to FIG. 14, the second base 52 can be fixedly connected (e.g., threadedly connected) to the second furniture part 24*a* via at least one fixing portion 61 in advance in order to mount the second furniture part 24*a* to the second rail 30. The carrying portion 40 of the second rail 30 serves to carry the second furniture part 24*a*. As shown in the drawing, there is a first distance G1 between the lateral side 124 of the second furniture part 24*a* and the first furniture part 22. The adjusting portion 78 (e.g., a spiral guide groove or guide channel) of the lateral adjustment member 54 can work with the transmission structure 80 (e.g., a projection located in the guide groove or guide channel) to change the first distance G1 as needed. The transmission structure 80 will be pressed against one of the two sidewalls of the guide groove or guide channel when the lateral adjustment member 54 is adjusted.

Figure 15:
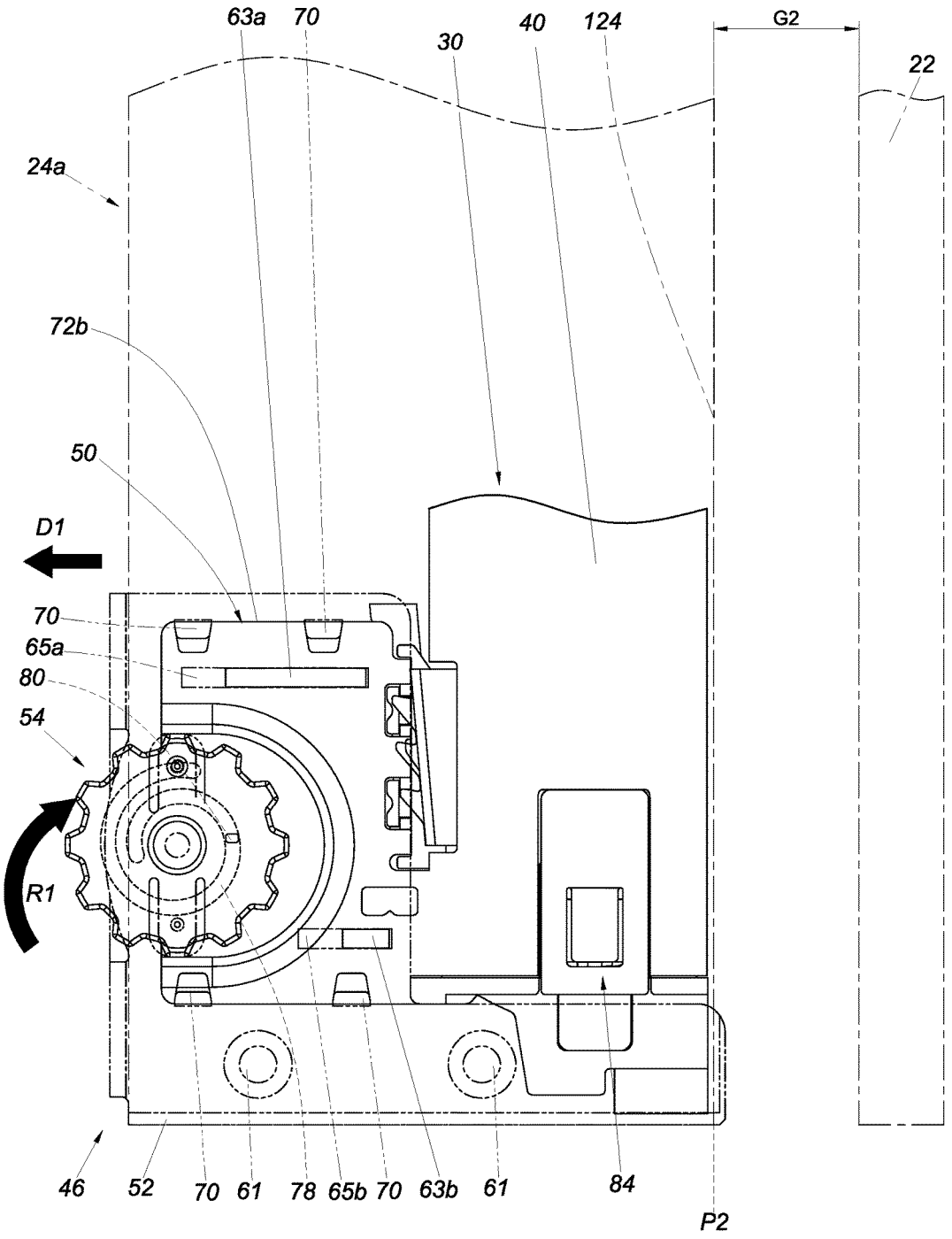
FIG. 15 shows that the second furniture part is adjusted, i.e., laterally displaced, by the lateral adjustment device of the coupling mechanism and is spaced apart from the first furniture part by a second distance in accordance with an embodiment of the present invention.

When it is desired to laterally adjust the second furniture part 24*a*, referring to FIG. 15, the operator may adjust the lateral adjustment member 54 in order to displace the second base 52 with respect to the first base 50, thereby changing the lateral position of the second furniture part 24*a* with respect to the first furniture part 22 or the second rail 30. For example, the operator may rotate the lateral adjustment member 54 in a first rotation direction R1 so that the adjusting portion 78 of the lateral adjustment member 54 works with the transmission structure 80 to displace the second base 52 in a first lateral direction D1 with respect to the second rail 30 or the first base 50, thus moving the second furniture part 24*a* from a first lateral position P1 (see FIG. 14) to a second lateral position P2 with respect to the second rail 30. Consequently, the first distance G1 between the lateral side 124 of the second furniture part 24*a* and the first furniture part 22 is changed to a second distance G2, wherein the second distance G2 is larger than the first distance G1.

Figure 16:
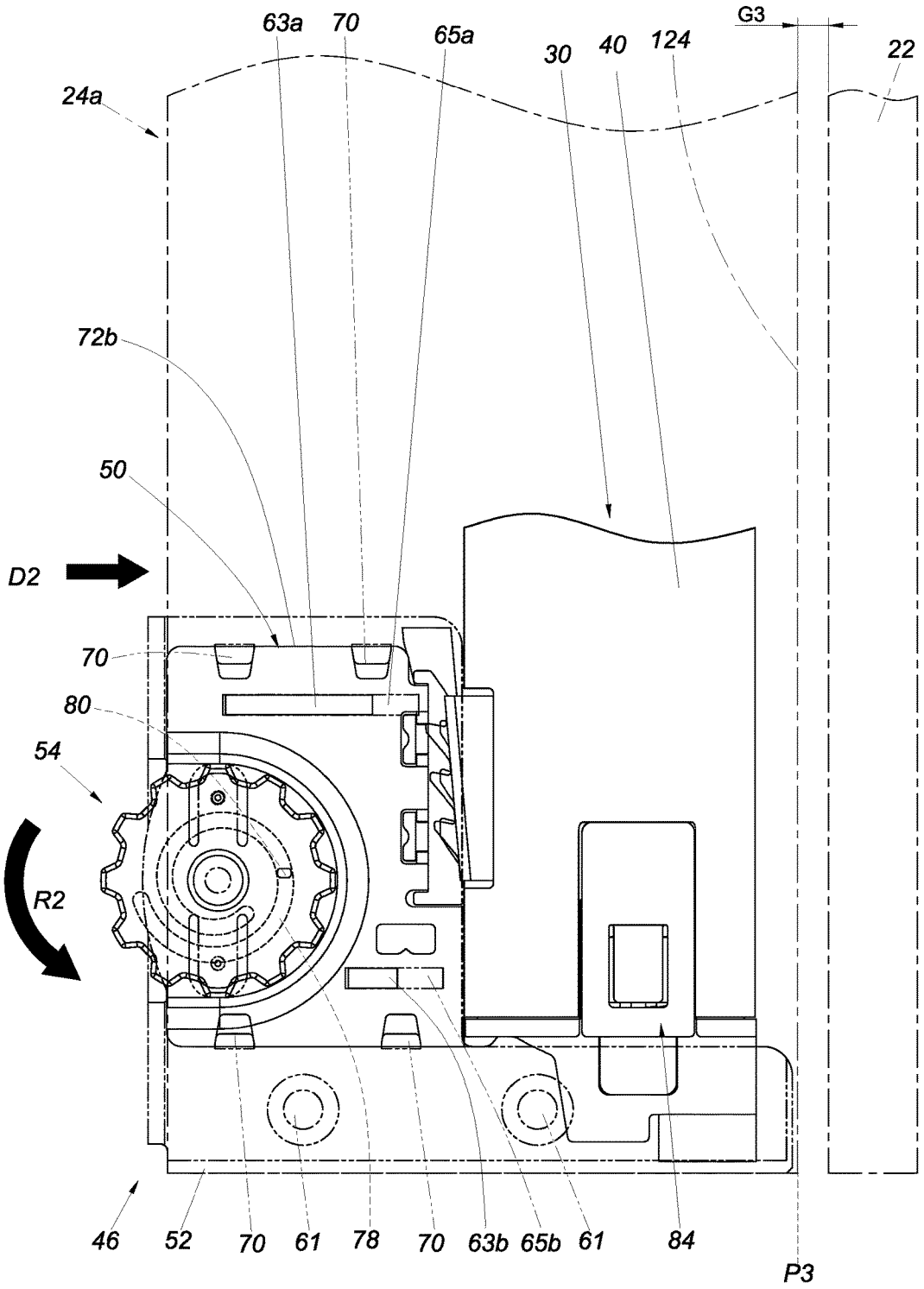
FIG. 16 shows that the second furniture part is further adjusted, i.e., laterally displaced, by the lateral adjustment device of the coupling mechanism and is spaced apart from the first furniture part by a third distance in accordance with an embodiment of the present invention.

When it is desired to further adjust, or laterally displace, the second furniture part 24*a* toward the first furniture part 22, referring to FIG. 16, the operator rotates the lateral adjustment member 54 in a second rotation direction R2 so that, with the adjusting portion 78 of the lateral adjustment member 54 working with the transmission structure 80, the second base 52 is displaced in a second lateral direction D2 with respect to the second rail 30 or the first base 50, wherein the second lateral direction D2 is the opposite direction of the first lateral direction D1. As a result, the second furniture part 24*a* is moved from the second lateral position P2 to a third lateral position P3 with respect to the second rail 30, and the second distance G2 between the lateral side 124 of the second furniture part 24*a* and the first furniture part 22 is changed to a third distance G3, wherein the third distance G3 is smaller than the first distance G1.

It can be known from the above that the transmission structure 80 serves to convert a rotary movement of the lateral adjustment member 54 (or the adjusting portion 78) into a linear displacement or lateral displacement of the second base 52 with respect to the first base 50.

The slide rail assembly 26 and/or the coupling mechanism 34 of the present invention preferably has the following features:

1. The height adjustment device 48 can be used to adjust the height of the second furniture part 24*a* with respect to a slide rail (e.g., the second rail 30).
2. The lateral adjustment device 46 can be used to adjust the lateral position of the second furniture part 24*a* with respect to a slide rail (e.g., the second rail 30) or the first furniture part 22.
3. The lateral adjustment device 46 and the height adjustment device 48 are detachably fixed to a slide rail (e.g., the second rail 30).
4. The second base 52 is pressed against the cushioning portion 92 of the coupling base 82 in order for a cushioning movement of the cushioning portion 92 to compensate for a longitudinal gap K that may exist between the first base 50 and the second rail 30.
5. The coupling base 82 is mounted on a slide rail (e.g., the second rail 30), includes the elastic portion 90, and is detachably engaged with the first base 50.

While the present invention has been disclosed through the preferred embodiment described above, it should be understood that the embodiment is not intended to be restrictive of the scope of the invention. The scope of patent protection sought by the applicant is defined by the appended claims.

What is claimed is:

1. A slide rail assembly, comprising:

a first rail;

a second rail longitudinally displaceable with respect to the first rail; and a coupling mechanism adjacent to the second rail, wherein the coupling mechanism comprises:

a coupling base detachably fixed to the second rail;

a first base detachably engaged to the coupling base and a second base displaceably coupled to the first base;

a supporting member coupled to the coupling base and including a supporting portion;

a height adjustment member rotatably coupled to the supporting member for rotation about a first axis to displace and thereby adjust the supporting member with respect to the coupling base in order to change a height of the supporting portion of the supporting member with respect to the second rail through a guiding feature;

a lateral adjustment member rotatably disposed on the first base for rotation about a second axis transversely oriented relative to the first axis; and a transmission structure for converting a rotary movement of the lateral adjustment member into a linear displacement of the second base with respect to the first base, wherein the lateral adjustment member is configured for displacing and thereby adjusting the second base with respect to the first base to displace a furniture part coupled thereto in lateral position relative to the second rail.

2. The slide rail assembly of claim 1, wherein the second rail includes a front portion and a rear portion, the coupling base is mounted on the second rail at a position adjacent to the front portion of the second rail, and the guiding feature includes one of an inclined surface and a curved surface.

3. The slide rail assembly of claim 1, wherein the height adjustment member is rotatably mounted on the coupling base, and the height adjustment member and the supporting member have corresponding longitudinal threaded structures.

4. The slide rail assembly of claim 1, wherein the coupling base includes an elastic portion, the first base includes an engaging structure, the elastic portion of the coupling base is detachably engaged with the engaging structure of the first base and includes at least one first engaging section, and the engaging structure includes at least one second engaging section corresponding to the first engaging section.

5. The slide rail assembly of claim 1, wherein the coupling base includes a cushioning portion, the first base includes a mounting portion pressed against a first sidewall of the second rail, and the cushioning portion is configured to be pressed against the second base in order for a cushioning movement of the cushioning portion to compensate for a possible longitudinal gap between the first base and the second rail.

6. The slide rail assembly of claim 1, wherein the first base includes a first feature, the second base includes a second feature, one of the first feature and the second feature includes at least one projection, the other of the first feature and the second feature includes at least one receiving space for receiving the at least one projection, and the at least one receiving space is larger than the at least one projection so that, with the first feature and the second feature working with each other, the second base is displaceable within a limited range with respect to the first base.

7. The slide rail assembly of claim 1, wherein the lateral adjustment member is pivotally connected to the second base and includes an adjusting portion, the first base includes the transmission structure, the transmission structure is configured to work with the adjusting portion, the adjusting portion is a substantially spiral guide groove, and the transmission structure is a projection located in the guide groove.

8. The slide rail assembly of claim 1, wherein the supporting member includes a first threaded structure, the height adjustment member includes a second threaded structure corresponding to the first threaded structure, and the first threaded structure and the second threaded structure are substantially longitudinally arranged.

* * * * *